US005643078A

United States Patent [19]

Sairanen et al.

[11] Patent Number: 5,643,078

[45] Date of Patent: Jul. 1, 1997

[54] METHOD AND SYSTEM FOR AIR-CONDITIONING A COATING STATION FOR A PAPER WEB OR EQUIVALENT

[75] Inventors: Paavo Sairanen, Turku; Jan Lindström, Naantali, both of Finland; Osmo Lamminpää , Knoxville, Tenn.

[73] Assignee: Valmet Corporation, Helsinki, Finland

[21] Appl. No.: 563,628

[22] Filed: Nov. 28, 1995

[30] Foreign Application Priority Data

Dec. 2, 1994 [FI] Finland ..... 945685

[51] Int. Cl.[6] ..... F24F 3/00

[52] U.S. Cl. ..... 454/66; 454/49

[58] Field of Search ..... 454/49, 66, 191, 454/249, 252

[56] References Cited

U.S. PATENT DOCUMENTS

| | | | |
|---|---|---|---|
| 2,362,063 | 11/1944 | Fryer et al. | 454/66 |
| 2,710,574 | 6/1955 | Runion | 454/66 |
| 4,125,641 | 11/1978 | Wallsten | 427/296 |
| 4,451,000 | 5/1984 | Stephens | 454/49 X |
| 5,263,897 | 11/1993 | Kondo et al. | 454/66 X |

FOREIGN PATENT DOCUMENTS

| | | | |
|---|---|---|---|
| 76264 | 6/1988 | Finland . | |
| 3701406 | 7/1988 | Germany . | |
| 1002741 | 3/1983 | U.S.S.R. | 454/49 |
| 1514429 | 10/1989 | U.S.S.R. | 454/49 |

*Primary Examiner*—Harold Joyce

*Attorney, Agent, or Firm*—Steinberg, Raskin & Davidson, P.C.

[57] ABSTRACT

A method and system for air-conditioning of a coating station for a paper web in which hot and moist air is removed from the environment of the coating station. In the method, a dry and cool air flow is blown into a working area of a person working at the coating station, to the direct vicinity of the person, so as to air-condition the working area and to constitute breathing air for the person. Out of the working area of the person, from the direct vicinity of the person, hot and moist air is removed as a suction flow. The system for air-conditioning of a coating station for a paper web or equivalent is placed in connection with the coating station and includes an exhaust air device. The air-conditioning system is placed in connection with the frame constructions of the coating station and includes a blow device for producing an air flow so as to air-condition the working area of the person working at the coating station and to constitute breathing air for the person as well as at least one suction device for removing hot and moist air out of the working area of the person.

15 Claims, 2 Drawing Sheets

METHOD AND SYSTEM FOR AIR-CONDITIONING A COATING STATION FOR A PAPER WEB OR EQUIVALENT

FIELD OF THE INVENTION

The present invention relates to a method for air-conditioning a coating station for a paper web or equivalent in which hot and moist air is removed from the environment of the coating station.

Further, the invention relates to a system for air-conditioning a coating station for a paper web or equivalent which is placed in connection with the coating station and which comprises an exhaust air device.

BACKGROUND OF THE INVENTION

In connection with coating machines of paper and board machines, one persistent problem is the working conditions of the maintenance personnel therefor, and a particular problem has resulted from the working temperature, which has been uncomfortably high, even higher than 50° C., in certain applications. The effect of the temperature on the working conditions is emphasized further by the fact that the air is also quite moist as a result of the moisture evaporating from the web and from the coating agent and of any moisture that may evaporate, for example, from coating-agent tanks.

Some coating stations, such as certain size press stations, are quite problematic in this respect because in these machines the maintenance personnel must carry out adjustments on the machine at regular intervals when the machine is running. Thus, in this context, they have to work in a hot and moist environment even during long periods of time.

In the constructions known in the prior art, attention has not been paid to these problems. In some prior art applications, an open hood has been used which is designed to absorb heat and moisture and possible gases out of the machine space surrounding the coating station, but the temperature and the moisture content in the working area may still remain quite high. Also, the use of such open hoods for removal of air is quite expensive.

OBJECTS AND SUMMARY OF THE INVENTION

An object of the present invention is to provide a new and improved method and apparatus for air-conditioning a coating station for a paper web or equivalent.

Another object of the present invention is to provide a new and improved air-conditioning method and apparatus for a coating station for a paper web by whose means the working conditions in connection with the coating station can be made better from the point of view of the maintenance and operation personnel so that the temperature and the moisture content in the air in and surrounding the coating station are lower than in prior art constructions.

In view of achieving the objects stated above and others, in the method in accordance with the invention, a dry and cool air flow is blown into the working area of the person working at the coating station, to the direct vicinity of the person, so as to air-condition the working area and to constitute breathing air for the person. Further, in the method, hot and moist air is removed as a suction flow out of the working area of the person from the direct vicinity of the person. The amount of cool and dry air being directed into the working area and the amount of hot and moist air being removed from the working area can be regulated by suitable regulation means to comfortably ventilate the working area. Also, the amount of cool and dry air being directed into the working area and the amount of hot and moist air being removed from the working area can be regulated by appropriate regulation means to control the moisture content of the air in the working area. The inflow of cool and dry air may be independent of or dependent on the exhaust of the hot and moist air.

In the apparatus in accordance with the invention, an air-conditioning construction is placed in connection with the frame constructions of the coating station. The air-conditioning construction comprises a blow device for producing an air flow so as to air-condition the working area of the person working at the coating station and to constitute breathing air for the person as well as at least one suction device for removing hot and moist air out of the working area of the person.

According to the invention, in connection with the coating station, ducts for cooling air and exhaust air are placed. By means of the ducts, the temperature in and surrounding the coating station can be lowered, depending on the location from about 50° C. to about 65° C., preferably to about 35° C. to about 45° C., i.e., a decrease of between 15° C. and 30° C. and preferably only around 20° C., and the moisture content in the air can be lowered (to one half of what it was without the cooling air ducts and exhaust air ducts) from about 50 to about 70 grams of $H_2O$ per kilogram of dry air preferably to about 25 to about 40 grams of $H_2O$ per kilogram of dry air. According to the invention, into the working area, intake air is also introduced under control into the breathing zone and moreover, according to the invention, the hot and moist air flow that is pumped along with the web can be cut off by means of an air knife and by means of such a positioning of the air devices that, by their means, an obstacle to flow is formed. In this situation, the hot and moist air cannot penetrate into the working area of the maintenance personnel. An additional advantageous feature of the invention is an air foil nozzle so as to seal the area between the exhaust-air space and the paper reel. Moreover, it is possible to employ a physical flow obstacle arranged in connection with the devices.

According to the invention, dry and fresh air is introduced into the area of the coating station, in particular into the area in which the maintenance personnel work so as to absorb the load of heat and moisture that is liberated from the coating process and/or from the paper web. Also, in connection with the frame constructions of the coating station, air nozzles are placed in such a position to provide fresh and dry breathing air for the operator of the machine and, at the same time, blow away any detrimental gases that may be produced in the process. The removal of air is carried out as a uniform controlled air flow and spreading of the load of moisture and heat into the rest of the machine space is prevented.

The invention also provides the advantage that moisture damage to the structures is reduced.

The coating station air-conditioning system in accordance with the present invention operates independently, irrespective of any other air-conditioning devices that may be present in the space or of air-conditioning devices of the process. Even if there were a poorly operating air-conditioning system in the space, that does not disturb the operation of the system in accordance with the present invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENT

Figure 1:
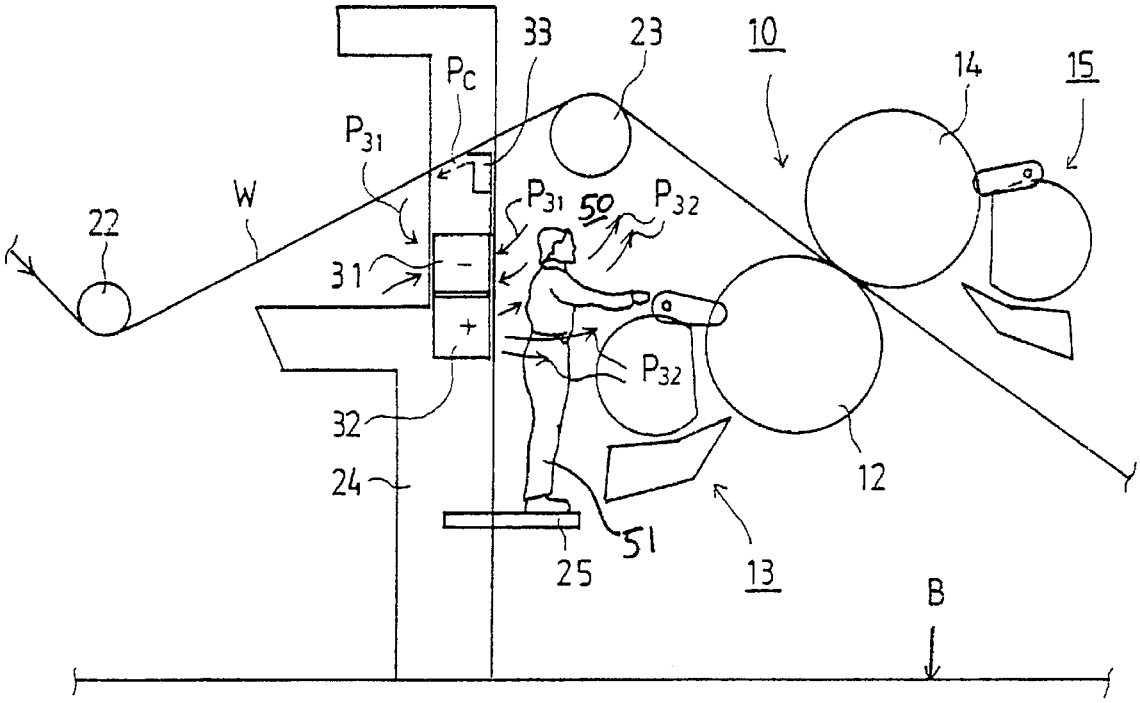
FIG. 1 is a fully schematic illustration of a size press which is provided with an air-conditioning arrangement in accordance with the present invention which operates according to the method in accordance with the invention.

Referring to the accompanying drawings wherein the same reference numerals refer to the same or similar elements, in relation to FIGS. 1–3, the invention will be described in more detail with reference to size-press applications. This does not confine the scope of the invention to size presses alone, but the invention is suitable for use in connection with all coating stations in which the working conditions of the maintenance personnel are problematic because of hot and moist air.

In FIG. 1, a size press is denoted generally with the reference numeral 10. The size press 10 comprises a frame beam 24 mounted on a base B. The frame constructions proper of the size press are not shown in the drawing. The size press includes nip-defining size-press rolls 12,14, in connection with which a respective coating device 13,15 is fitted. A paper web W is passed over alignment rolls 22,23 preceding a nip N defined between the size-press rolls 12,14 and then through the nip to be passed for further processing. The paper web W is coated in the nip N. The construction and the operation of the size press are not described in detail in this connection, primarily because they can be constructions in themselves known and of many different types.

A maintenance operator 51, for example when carrying out adjustments of the size press 10, stands on a tending platform 25 attached to the frame beam 24 which is positioned so that the operator 51 can reach the coating devices 13 of the lower size-press roll 12 readily from which platform 25. In the prior art arrangements, this area is quite hot because of the heat and moisture liberated at the coating station from the web W and from the equipment. The coating station is defined as the area in the vicinity of the coating devices 13,15 in which personnel would positioned themselves in order to tend to the coating devices 13,15.

According to the invention, at least one intake air device 32 is arranged in connection with the frame beam 24. By means of intake air device(s) 32, fresh and dry air is pumped and blown through openings in the intake air devices 32 around the maintenance operator 51. The intake air devices 32 are preferably placed, in the direction of width of the web W, in the middle of the web W, for example, in an area whose width is about half the width of the machine. Also in connection with the frame beam 24, at least one exhaust air device 31 is arranged and coupled to appropriate suction means (not shown). By means of the exhaust air device(s) 31, hot and moist air in the vicinity of the coating station, and primarily from the working area 50 of the maintenance operator 51, is absorbed, i.e., drawn through an opening or openings in the exhaust air device(s) 31. These exhaust air devices 31 are arranged preferably, in the direction of width of the machine, at the edges of the machine, for example at both sides of an intake air device 32. Also, in connection with the frame beam 24, an device 33 may be arranged near the web W for producing an air knife $P_C$ during running operation of the coating machine while during threading operation, the air knife $P_C$ is preferably tilted down from the tending side. By means of the air knife $P_C$, the hot and moist air flow that is pumped along with the web W is cut off, and by means of the air devices 32 and 31, air-conditioning air flows $P_{32}$,$P_{31}$, respectively, are formed in the working area 50 of the maintenance personnel 51. The working area 50 may be defined as the general area in which a person works to operate the coating device, i.e., that portion of the coating station accessible to the worker.

Figure 2:
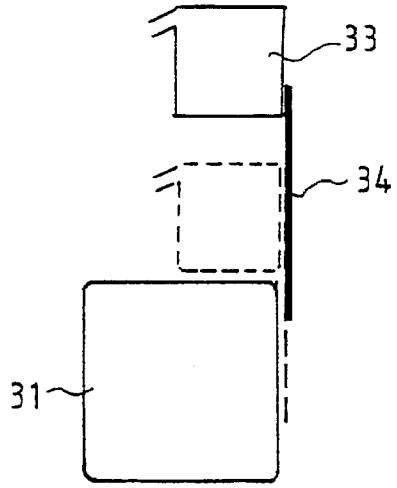
FIG. 2 is a schematic illustration of a detail of FIG. 1.

As shown in FIG. 2, flow obstacle means, such as a separate physical flow-obstacle wall 34, can be placed in connection with the exhaust air device 31 and the air knife device 33 to prevent access of air that is pumped along with the web W, which will pass from the left to the right in FIG. 2. In FIG. 2, the position of the device 33 during threading of the web W is shown by the dashed line.

Figure 3:
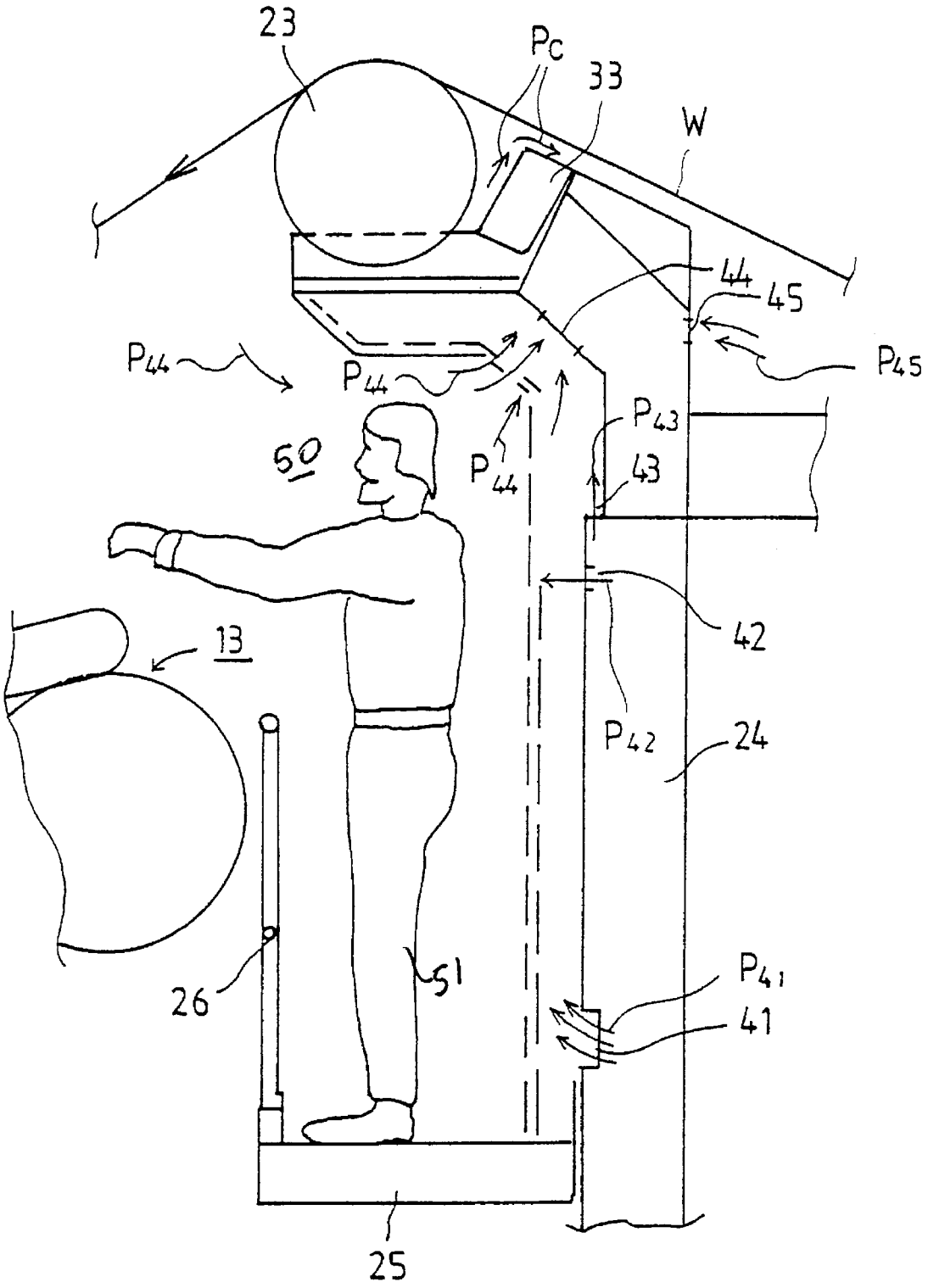
FIG. 3 schematically shows a second exemplifying embodiment of the invention.

FIG. 3 shows a similar arrangement for air-conditioning of the working area of the maintenance personnel 51 at a coating station. In this exemplifying embodiment, in connection with the tending platform 25, a protection handrail 26 is also placed, which prevents the fall of the maintenance personnel 51 onto the proximate coating device 13. The frame beam 24 in this embodiment includes flow openings 41,42,43 from which air is blown as the blowings $P_{41}$, $P_{42}$ and $P_{43}$, respectively. An exhaust opening 44 is arranged in the top portion of the frame beam 24 and coupled to appropriate suction means to draw in exhaust air, represented as exhaust air flow $P_{44}$.

In connection with the frame beam 24, at the inlet side of the web W which in this embodiment runs from right to left, an exhaust air opening 45 is also placed and coupled to suction means (not shown). By means of this exhaust air opening 45, hot and moist air that arrives along with the web W is removed. In the top portion of the frame beam 24, after the exhaust air opening 45 in the running direction of the web, a foil air-knife apparatus 33 is arranged. By means of the air-knife apparatus 33, an air flow $P_C$ is blown in the direction opposite to the running direction of the web W so as to prevent pumping of the air flowing along with the web W into the coating station. The air flow opening 41 arranged in connection with the frame beam 24 is the main air nozzle proper, and breathing air for the personnel is blown from the air opening 42, and the air opening 43 is used mainly for controlling the air flows since it is directed toward the exhaust air opening 44 and thus draw air along with it into the exhaust air opening 44, and the exhaust air openings are the openings 44 and 45. Air opening 43 may be directed along a plate which constitutes part of the frame beam 24.

In the air-conditioning arrangement, the temperature of the air that is blown to the working 50 area of the maintenance personnel 51 is from about 25° C. to about 30° C., and its moisture content is from about 10 to about 15 grams of $H_2O$ per kilogram of dry air. The blow velocities of the air flows from the intake devices are from about 0.5 meters per second to about 6 meters per second, preferably from about 2 meters per second to about 3 meters per second. Exhaust air is sucked through the exhaust air openings at a rate of from about 5 meters per second to about 15 meters per second, preferably from about 5 meters per second to about 8 meters per second, and the velocity of the air-knife blowing is from about 15 meters per second to about 30 meters per second, preferably from about 20 meters per second to about 25 meters per second. In this manner, it is possible to control the intake air flows and the exhaust air flows to regulate both the temperature of the working are and the moisture content of the working area.

The examples provided above are not meant to be exclusive. Many other variations of the present invention would be obvious to those skilled in the art, and are contemplated to be within the scope of the appended claims.

We claim:

1. A method for air-conditioning a coating station for a paper web, the coating station including a working area in which a person works to operate a coating device, comprising the steps of:

directing cool and dry air into the working area in the direct vicinity of the person to ventilate the working area and provide breathing air for the person, and removing hot and moist air as a suction flow from the working area from the direct vicinity of the person.

2. The method of claim 1, further comprising the step of:

preventing hot and moist air being pumped in connection with the web from entering into the working area.

3. The method of claim 1, further comprising the step of:

preventing hot and moist air being pumped in connection with the web from entering into the working area by directing in the vicinity of the web an air-knife blowing in a direction opposite to a direction of running of the web.

4. The method of claim 1, further comprising the step of:

preventing hot and moist air being pumped in connection with the web from entering into the working area of the person by positioning a flow-obstacle wall before the coating station in a running direction of the web.

5. The method of claim 1, further comprising the step of:

removing hot and moist air being pumped in connection with the web by drawing the hot and moist air into an exhaust air device before the web enters into the coating station.

6. The method of claim 1, further comprising the step of:

controlling air flows in the working area by directing at least one auxiliary air flow toward an exhaust air opening such that air is drawn by said at least one auxiliary air flow into said exhaust air opening.

7. The method of claim 1, further comprising the steps of:

directing an intake air flow of the cool and dry air in a middle area of width of the web, and drawing an exhaust air flow of the hot and moist air from lateral areas of the web.

8. The method of claim 1, further comprising the step of:

controlling the temperature in the working area by regulating the amount of cool and dry air being directed into the working area and the amount of hot and moist air being removed from the working area.

9. The method of claim 1, further comprising the step of:

control the moisture content of the air in the working area by regulating the amount of cool and dry air being directed into the working area and the amount of hot and moist air being removed from the working area.

10. An air-conditioning system arranged in connection with a frame member of a coating station for a paper web, the coating station including a working area in which a person works to operate a coating device, comprising blow means coupled to the frame member for directing at least one flow of cool and dry air into the working area to ventilate the working area, and suction means coupled to the frame member for removing hot and moist air from the working area.

11. The system of claim 10, further comprising nozzle means for producing an air-knife blowing proximate to the web and oriented in a direction opposite to a running direction of the web to prevent entry of hot and moist air flow pumped along with the web into the coating station.

12. The system of claim 10, further comprising a flow-obstacle wall arranged between the coating station and an area situated before the working area in a running direction of the web to prevent entry of hot and moist air pumped along with the web into the coating station.

13. The system of claim 10, wherein said suction means comprise a frame having an exhaust air opening, said blow means comprising a frame having a first nozzle opening for blowing a breathing-air flow directed substantially toward the working area of the person and a second nozzle opening for producing an auxiliary flow directed toward said exhaust air opening to guide an exhaust air flow into said exhaust air opening.

14. The system of claim 13, further comprising means for drawing hot and moist air that is being pumped in connection with the web as an exhaust flow before the hot and moist air arrives in the coating station with the web.

15. The system of claim 10, wherein said blow means are mounted on the frame member in a middle area of the width of the web, and said suction means are mounted on the frame member in both lateral areas of the web.

* * * * *